US007331204B1

(12) United States Patent
Hsieh

(10) Patent No.: US 7,331,204 B1
(45) Date of Patent: Feb. 19, 2008

(54) COMBINATION LOCK

(75) Inventor: Dick-Ming Hsieh, Tainan Hsien (TW)

(73) Assignee: Eminent Luggage Corp., Tainan Hsien (TW)

( * ) Notice: Subject to any disclaimer, the term of this patent is extended or adjusted under 35 U.S.C. 154(b) by 0 days.

(21) Appl. No.: 11/519,488

(22) Filed: Sep. 7, 2006

(51) Int. Cl.
*A45C 13/10* (2006.01)

(52) U.S. Cl. ..... 70/69; 70/70

(58) Field of Classification Search ..... 70/69, 70/70

See application file for complete search history.

(56) References Cited

U.S. PATENT DOCUMENTS 4,356,712 A * 11/1982 Bako ..... 70/69
5,237,842 A * 8/1993 Rasch et al. ..... 70/285
5,461,892 A * 10/1995 Hsieh ..... 70/73
6,527,306 B1 * 3/2003 Roncato ..... 292/33
6,912,880 B2 * 7/2005 Ling et al. ..... 70/71
6,941,777 B2 * 9/2005 Iwamoto ..... 70/69

* cited by examiner

*Primary Examiner*—Jennifer H. Gay
*Assistant Examiner*—Kristina R Gluchowski
(74) *Attorney, Agent, or Firm*—Christie, Parker & Hale, LLP

(57) ABSTRACT

A combination lock includes: a base mounted securely on a suitcase; a case locking mechanism mounted on the base and operable to move between locking and releasing positions; a dial lock mounted on the case locking mechanism, including a lock controlling member, and operable between locking and releasing states through operation of the lock controlling member; and a key-operated unlocking unit mounted on the case locking mechanism, including a core, and operable in a manner that the case locking mechanism is permitted to move from the locking position to the releasing position when the core is moved from a first angular position to a second angular position.

4 Claims, 8 Drawing Sheets

COMBINATION LOCK

BACKGROUND OF THE INVENTION

1. Field of the Invention

The invention relates to a combination lock, more particularly to a combination lock for locking two casing halves of a suitcase.

2. Description of the Related Art

As shown in FIG. 1, a conventional suitcase 1 normally includes first and second casing halves 11, 12, and a locking device that has a dial lock 131 and a key-operated unlocking unit 141 which are mounted on the first casing half 11 and which are operable to lock the first and second casing halves 11, 12, thereby providing dual protection from theft.

In order to facilitate the inspection of a baggage to be loaded on a plane, countries, such as the U.S.A., have regulated that suitcases bound for entry into the U.S.A. must be manufactured according to a design specification that requires the lock on the suitcase to be unlockable by a particular key for inspection purpose. However, since the dial lock 131 cannot be unlocked by the particular key, airport personnel may be forced to break the dial lock 131 for inspection.

SUMMARY OF THE INVENTION

Therefore, the object of the present invention is to provide a combination lock that can overcome the aforesaid drawback of the conventional locking device.

Accordingly, this invention provides a combination lock for locking first and second casing halves of a suitcase. The combination lock comprises: a base adapted to be mounted securely on one of the first and second casing halves; a case locking mechanism mounted on the base and operable to move between a locking position to lock the first and second casing halves, and a releasing position to release the locking action of the case locking mechanism on the first and second casing halves; a dial lock mounted on the case locking mechanism, including a lock controlling member, and operable between a locking state, in which the case locking mechanism is prevented from moving from the locking position to the releasing position by the lock controlling member, and a releasing state, in which the case locking mechanism is released from the lock controlling member and is permitted to move from the locking position to the releasing position; and a key-operated unlocking unit mounted on the case locking mechanism and including a core that is rotatable between first and second angular positions, and that is associated with the lock controlling member in such a manner that the case locking mechanism is prevented from moving from the locking position to the releasing position by the lock controlling member when the dial lock is disposed at the locking state and when the core is disposed at the first angular position, and that the case locking mechanism is released from the lock controlling member and is permitted to move from the locking position to the releasing position when the core is disposed at the second angular position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
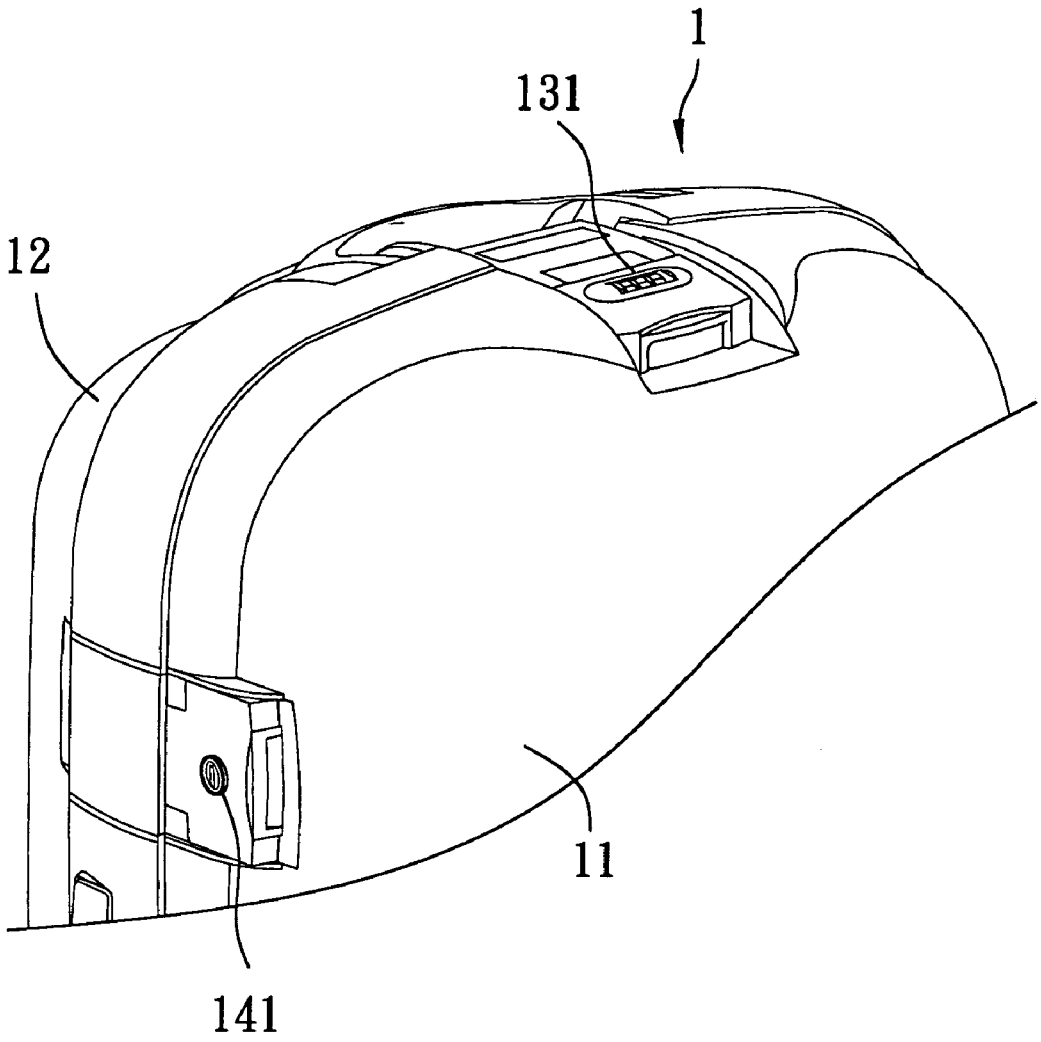
FIG. 1 PRIOR ART
FIG. 1 is a fragmentary perspective view of a conventional locking device for a suitcase.

Referring to FIGS. 2 to 5, the preferred embodiment of a combination lock 20 according to the present invention is shown to be adapted for locking first and second casing halves 21, 22 of a suitcase 2. The combination lock 20 includes: a base 3 adapted to be mounted securely on one of the first and second casing halves 21, 22 (in this embodiment, the base 3 is secured to the first casing half 21); a case locking mechanism 4 mounted on the base 3 and operable to move between a locking position (see FIG. 6) to lock the first and second casing halves 21, 22 (in this embodiment, the case locking mechanism 4 engages releasably the second casing half 22), and a releasing position (see FIG. 2) to release the locking action of the case locking mechanism 4 on the first and second casing halves 21, 22; a dial lock 5 mounted on the case locking mechanism 4, including a lock controlling member 54, and operable between a locking state (see FIG. 6), in which the case locking mechanism 4 is prevented from moving from the locking position to the releasing position by the lock controlling member 54, and a releasing state (see FIGS. 5 and 7), in which the case locking mechanism 4 is released from the lock controlling member 54 and is permitted to move from the locking position to the releasing position; and a key-operated unlocking unit 6 mounted on the case locking mechanism 4 and including a core 62 that is rotatable between first and second angular positions (see FIGS. 4 and 8), and that is associated with the lock controlling member 54 in such a manner that the case locking mechanism 4 is prevented from moving from the locking position to the releasing position by the lock controlling member 54 when the dial lock 5 is disposed at the locking state and when the core 62 is disposed at the first angular position (see FIG. 4), and that the case locking mechanism 4 is released from the lock controlling member 54 and is permitted to move from the locking position to the releasing position when the core 62 is disposed at the second angular position (see FIGS. 7 and 8).

Figure 5:
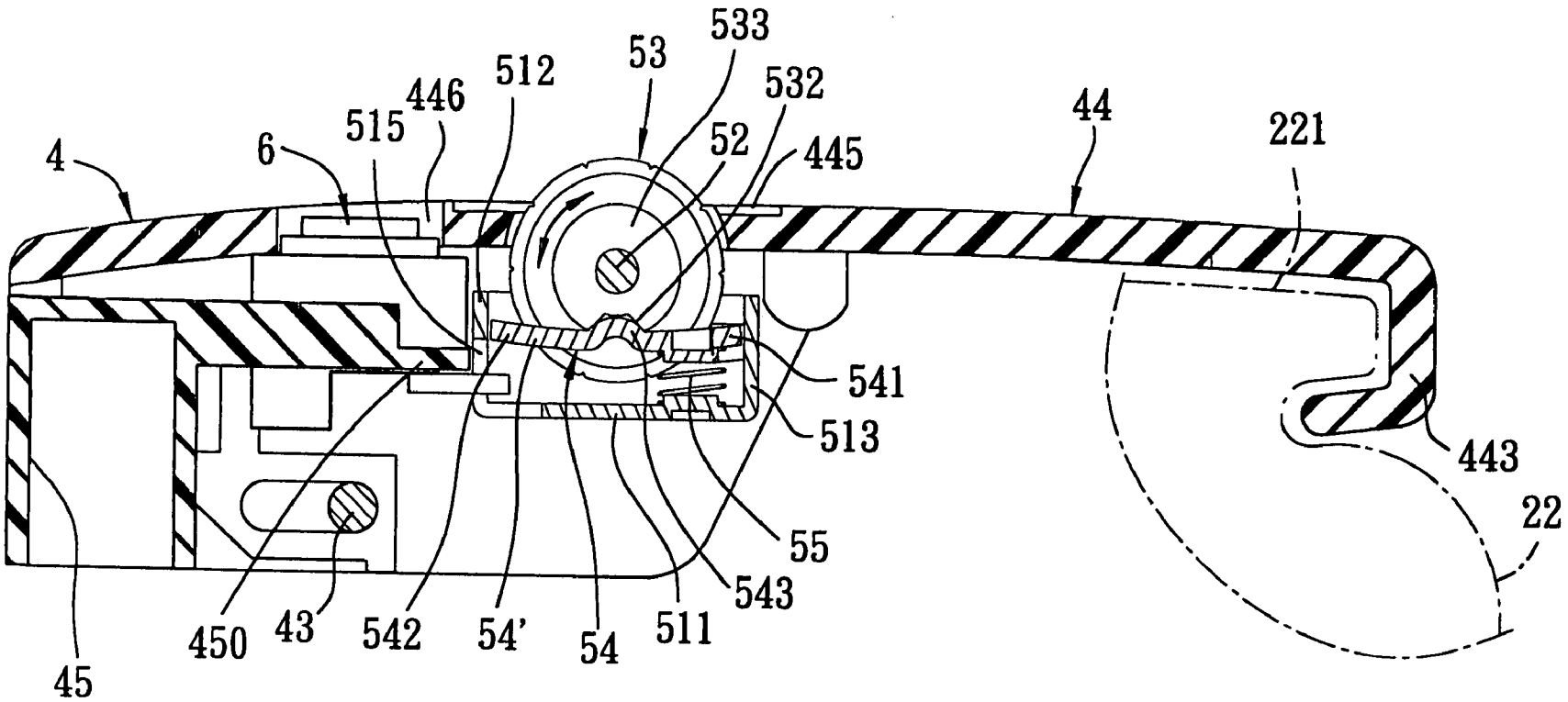
FIG. 5 is a cross-sectional view taken along line V-Vin FIG. 4.
Figure 6:
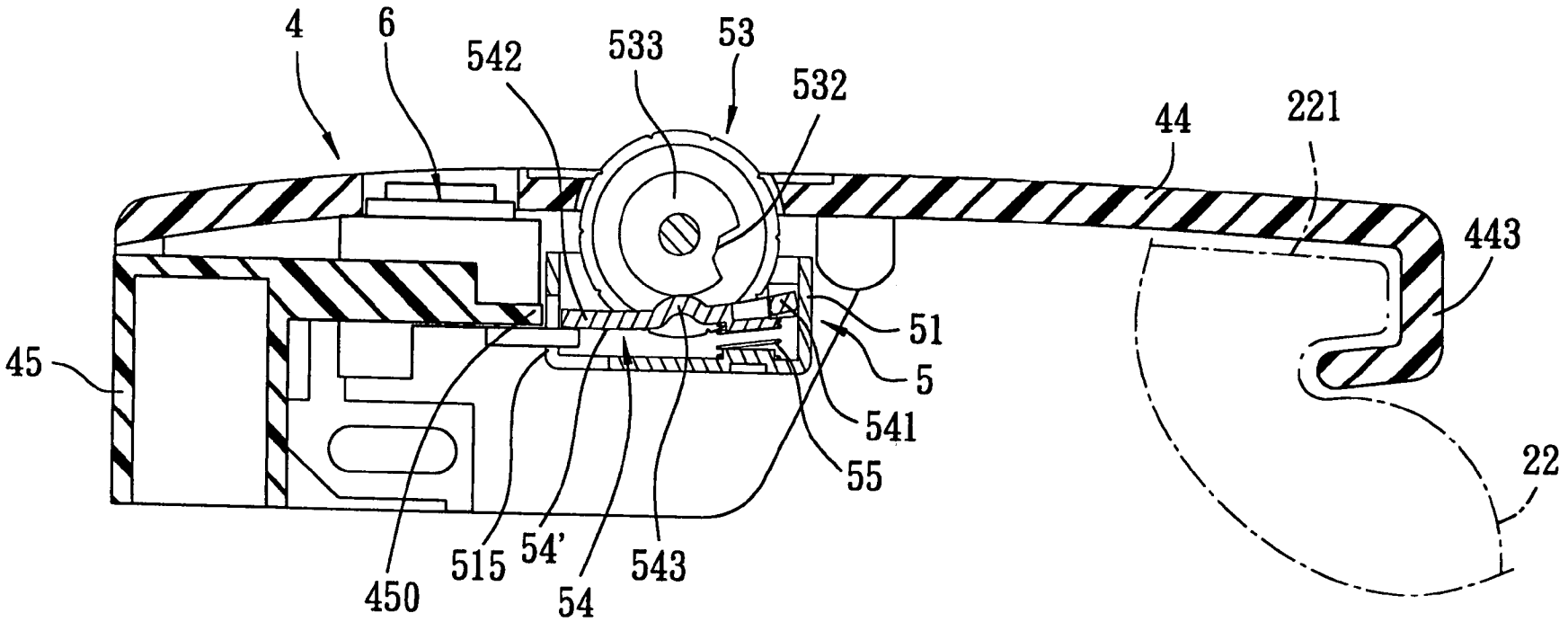
FIG. 6 is a cross-sectional view illustrating another state where the limiting lever is disposed at a middle position.
Figure 7:
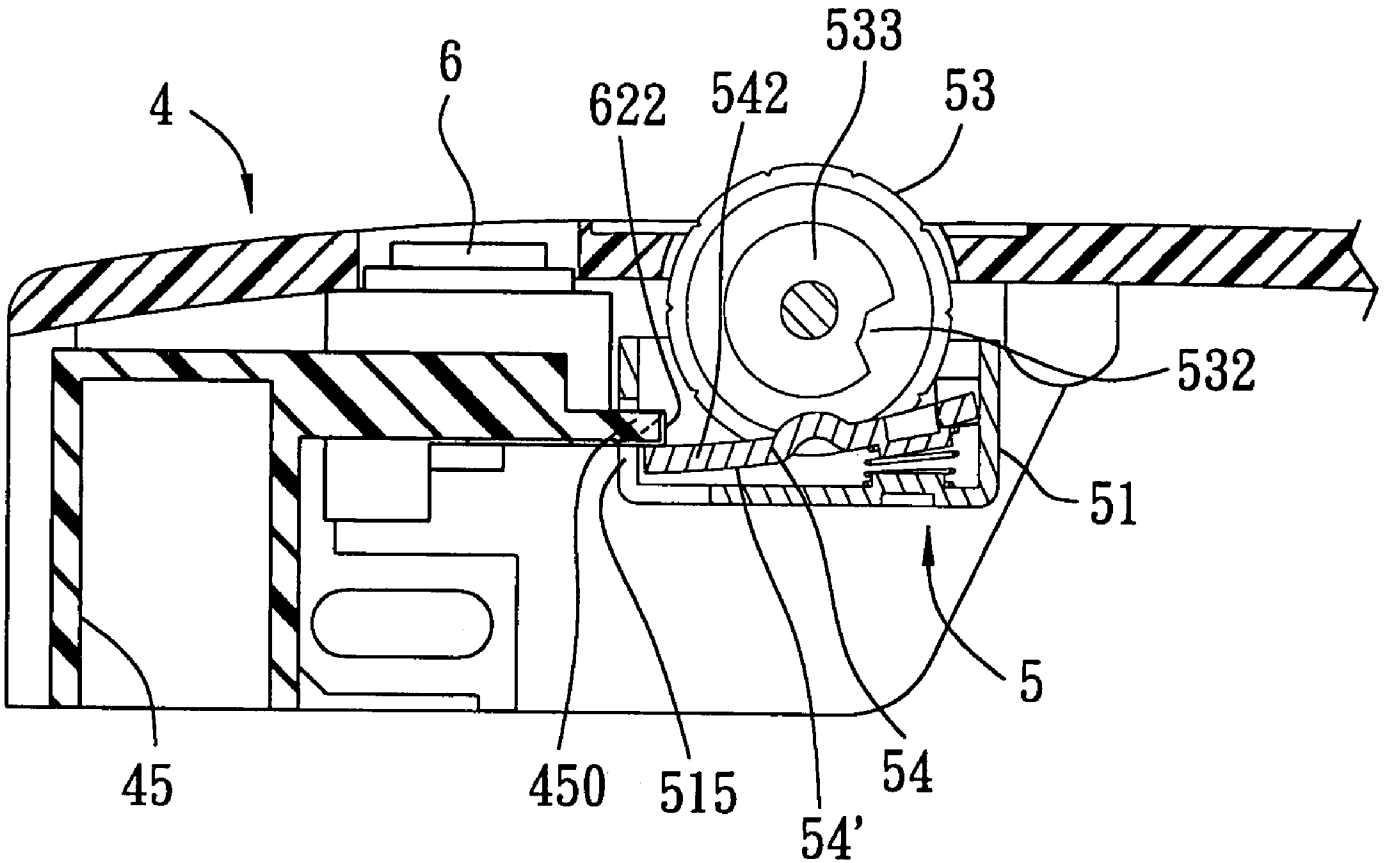
FIG. 7 is a cross-sectional view illustrating yet another state where the limiting lever is disposed at a lower position.

In this embodiment, the lock controlling member 54 includes a limiting lever 54' that is fulcrumable among a middle position, in which the case locking mechanism 4 is prevented from moving from the locking position to the releasing position by the limiting lever 54' as best shown in FIG. 6, an upper position, in which the case locking mechanism 4 is released from the limiting lever 54' and is permitted to move from the locking position to the releasing position as best shown in FIG. 5, and a lower position, in which the case locking mechanism 4 is released from the limiting lever 54' and is permitted to move from the locking position to the releasing position as best shown in FIG. 7.

Referring back to FIGS. 2, 3 and 5, the case locking mechanism 4 includes a case latching member 44 that is rotatable between a latching position (see FIG. 5) to engage the second casing half 22 to thereby dispose the case locking mechanism 4 at the locking position, and an unlatching position (see FIG. 2) to disengage from the second casing half 22 to thereby dispose the case locking mechanism 4 at the releasing position. The case locking mechanism 4 further includes a spring-biased pressable button 45 that is mounted movably on the case latching member 44 and that is movable in a moving direction between pressed and non-pressed positions (see FIGS. 7 and 6 or FIGS. 8 and 4) and that is formed with a stopper 450. The case latching member 44 is permitted to rotate from the latching position to the unlatching position when the pressable button 45 is disposed at the pressed position, and is prevented from moving from the latching position to the unlatching position when the pressable button 45 is disposed at the non-pressed position. The limiting lever 54' has a limiting end 542 that confronts and that is aligned with the stopper 450 in the moving direction (see FIG. 6) when the limiting lever 54' is disposed at the middle position, thereby preventing the pressable button 45 from moving from the non-pressed position to the pressed position, and that is offset from the stopper 450 in the moving direction when the limiting lever 54' is disposed at one of the upper and lower positions (as best shown in FIGS. 5 and 7, respectively), thereby permitting the pressable button 45 to move from the non-pressed position to the pressed position.

Figure 4:
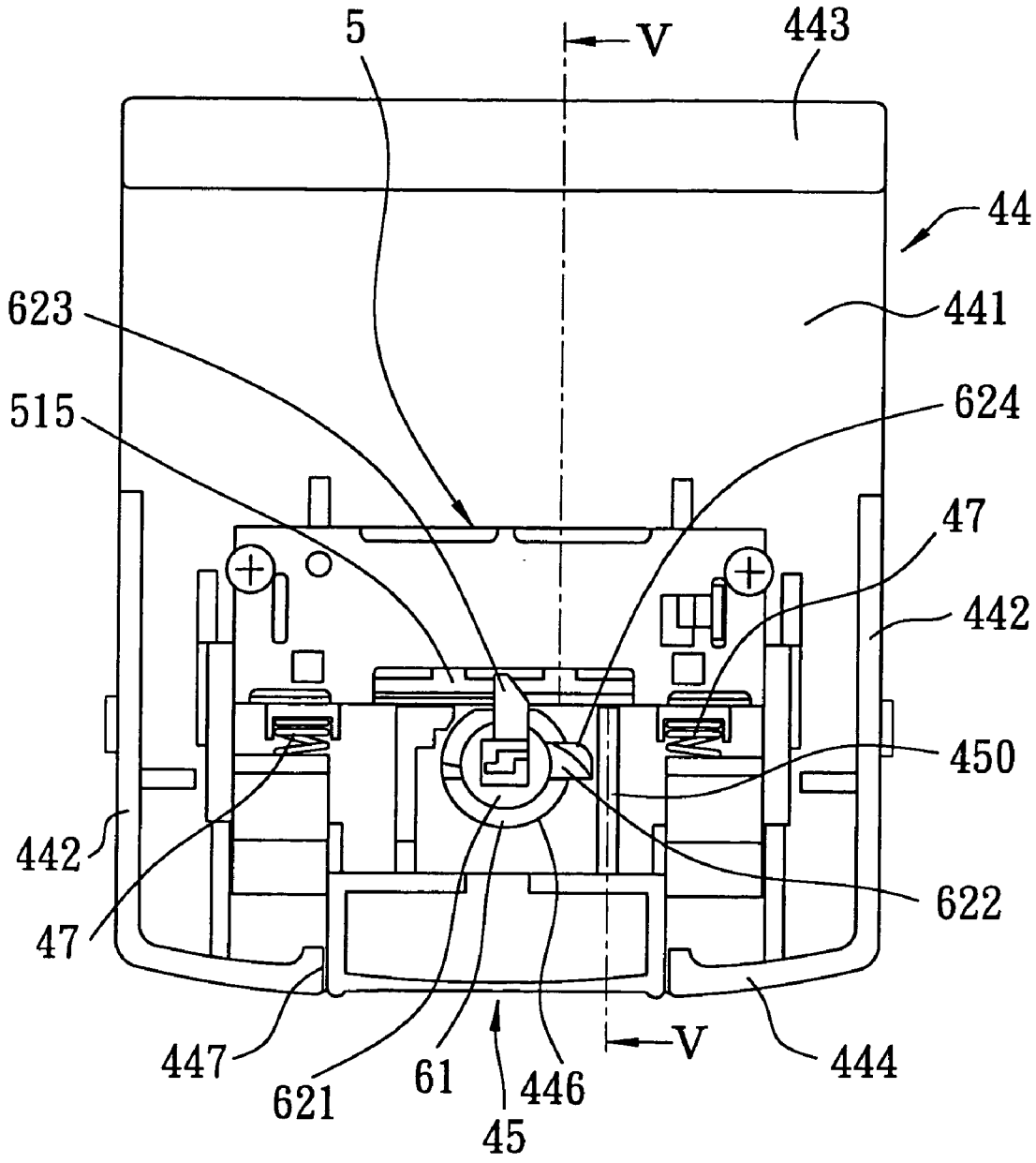
FIG. 4 is a schematic view of the preferred embodiment, viewed from a bottom side of the preferred embodiment in a state where a limiting lever is disposed at an upper position.
Figure 8:
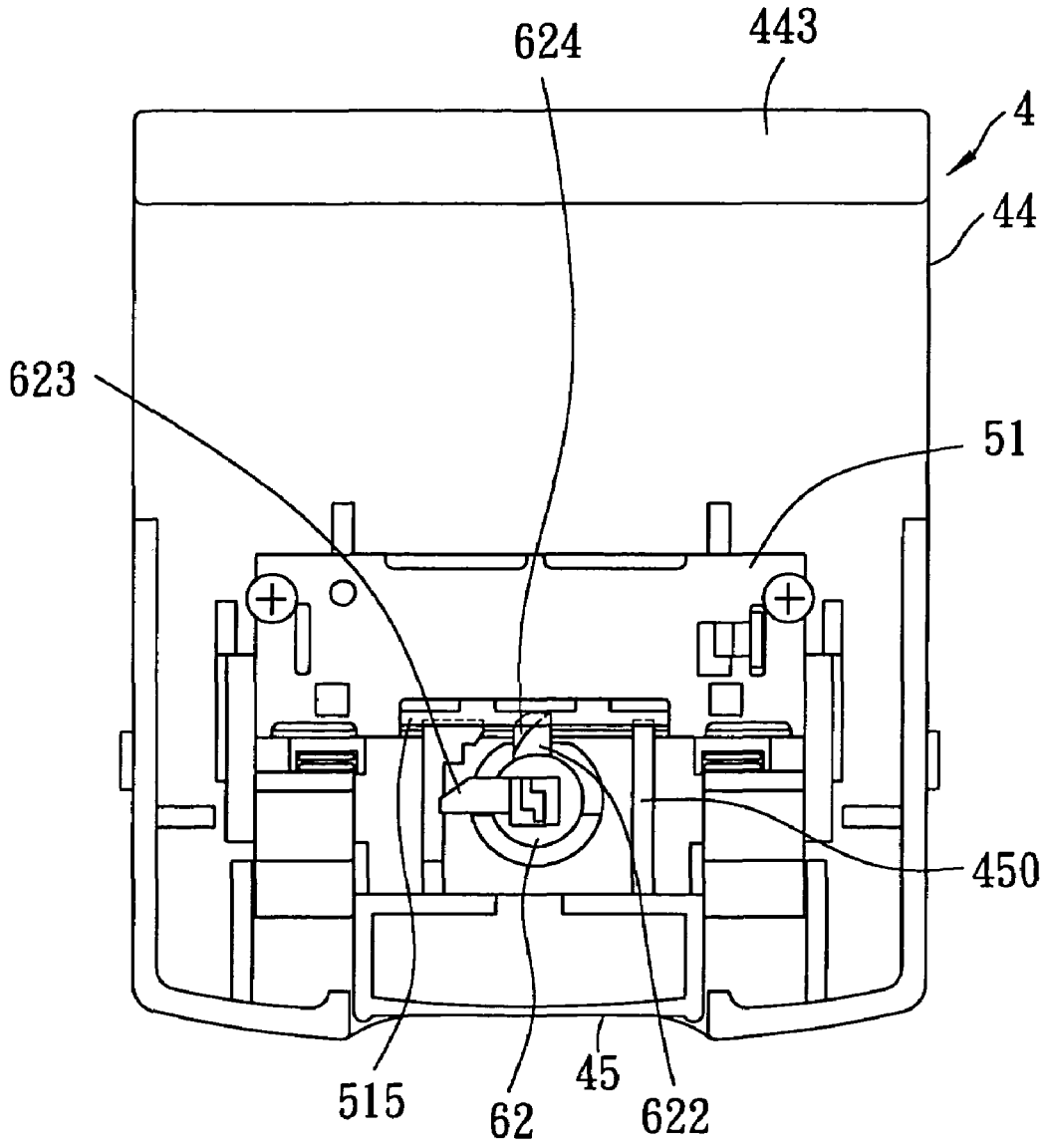
FIG. 8 is a schematic view of the preferred embodiment, viewed from the bottom side of the preferred embodiment in the state where the limiting lever is disposed at the lower position.

In this embodiment, the core 62 of the key-operated unlocking unit 6 has a cylindrical wall 621 that is formed with a driving protrusion 622 protruding radially therefrom and having a curved guiding face 624 (see FIGS. 4 and 8). The limiting lever 54' can be moved from the middle position to the lower position by the driving protrusion 622, which presses the limiting lever 54' downward, when the core 62 is rotated from the first angular position to the second angular position, as best shown in FIGS. 4 and 8. The curved guiding face 624 of the driving protrusion 622 is in sliding contact with the limiting end 542 of the limiting lever 54' during movement of the core 62 from the first angular position to the second angular position. The cylindrical wall 620 of the core 62 is further formed with a stopping protrusion 623 protruding therefrom and displaced angularly and axially spaced apart from the driving protrusion 622 for limiting rotation of the core 62 to be within the first and second angular positions.

Figure 2:
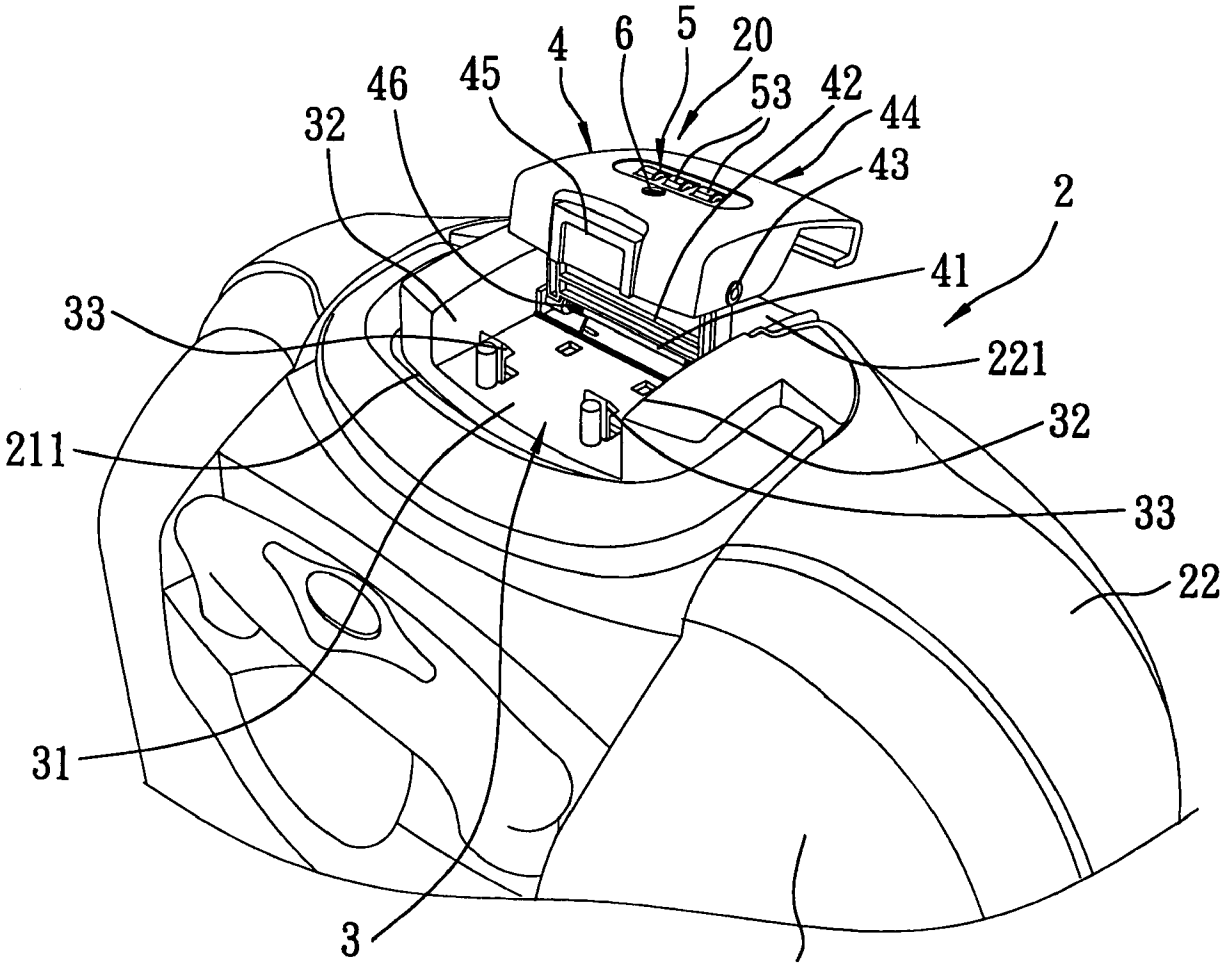
FIG. 2 is a fragmentary perspective view of the preferred embodiment of a combination lock for a suitcase according to the present invention.

As shown in FIG. 2, in this embodiment, the first casing half 21 has a lateral side with a lock mounting face 211 on which the base 3 is mounted. The second casing half 22 has a lateral side with a lock engaging protrusion 221 that is engageable with the case latching member 44 for latching operation.

The base 3 includes a bottom wall 31 fixedly mounted on the lock mounting face 211 of the first casing half 21, a pair of lateral walls 32 spaced apart from each other and extending upwardly from the bottom wall 31, and a pair of spaced apart engaging hooks 33 extending upwardly from the bottom wall 31.

The case locking mechanism 4 further includes a first pivot pin 41 transverse to the moving direction, a coupling seat 42 pivoted to the lateral walls 32 of the base 3 through the first pivot pin 41, a second pivot pin 43 through which the case latching member 44 is pivoted to the coupling seat 42, and a pair of torsion springs 46 sleeved on the first pivot pin 41 for urging the coupling seat 42 together with the case latching member 44 to pivot in an upward direction away from the bottom wall 31. The case latching member 44 includes a latch base wall 441 (see FIG. 3) that is formed with a dial slot 445 and a key hole 446 proximate to the dial slot 445, a pair of latch mounting walls 442 spaced apart from each other, extending downwardly from the latch base wall 441 and formed with pivot holes for extension of the second pivot pin 43 therethrough, a latch engaging hook 443 extending downwardly from the latch base wall 441 and engageable with the lock engaging protrusion 221 of the second casing half 22 (see FIGS. 5 and 6), and a connecting wall 444 extending from the latch mounting walls 442 and formed with a notch 447 for extension of the pressable button 45 therethrough.

The pressable button 45 further includes a press part 452 received in the notch 447 in the connecting wall 444 of the case latching member 44, a pair of wing portions 451 that extend from two opposite sides of the press part 452 toward the latch engaging hook 443, that are respectively formed with engaging recesses 453 that are respectively engageable with the engaging hooks 33, and a pair of compression springs 47 disposed between the wing portions 451 for urging the press part 452 to move away from the latch engaging hook 443 in the moving direction. When the dial lock 5 is disposed at the releasing state or the core 62 is disposed at the second angular position (i.e., when the limiting lever 54' is disposed at the upper position or the lower position) and when the press part 452 is pressed against the urging force of the compression springs 47 to move the pressable button 45 from the non-pressed position to the pressed position, the engaging recesses 453 are disengaged from the engaging hooks 33, thereby permitting pivoting movement of the case locking mechanism 4 relative to the base 3 from the locking position to the releasing position (as best shown in FIG. 2, upon releasing from the engaging hooks 33, the coupling seat 42 together with the pressable button 45 is permitted to rotate upwardly by the urging action of the torsion springs 46, which results in lateral movement of the case latching member 44, which, in turn, results in disengagement between the latch engaging hook 443 and the lock engaging protrusion 221).

Figure 3:
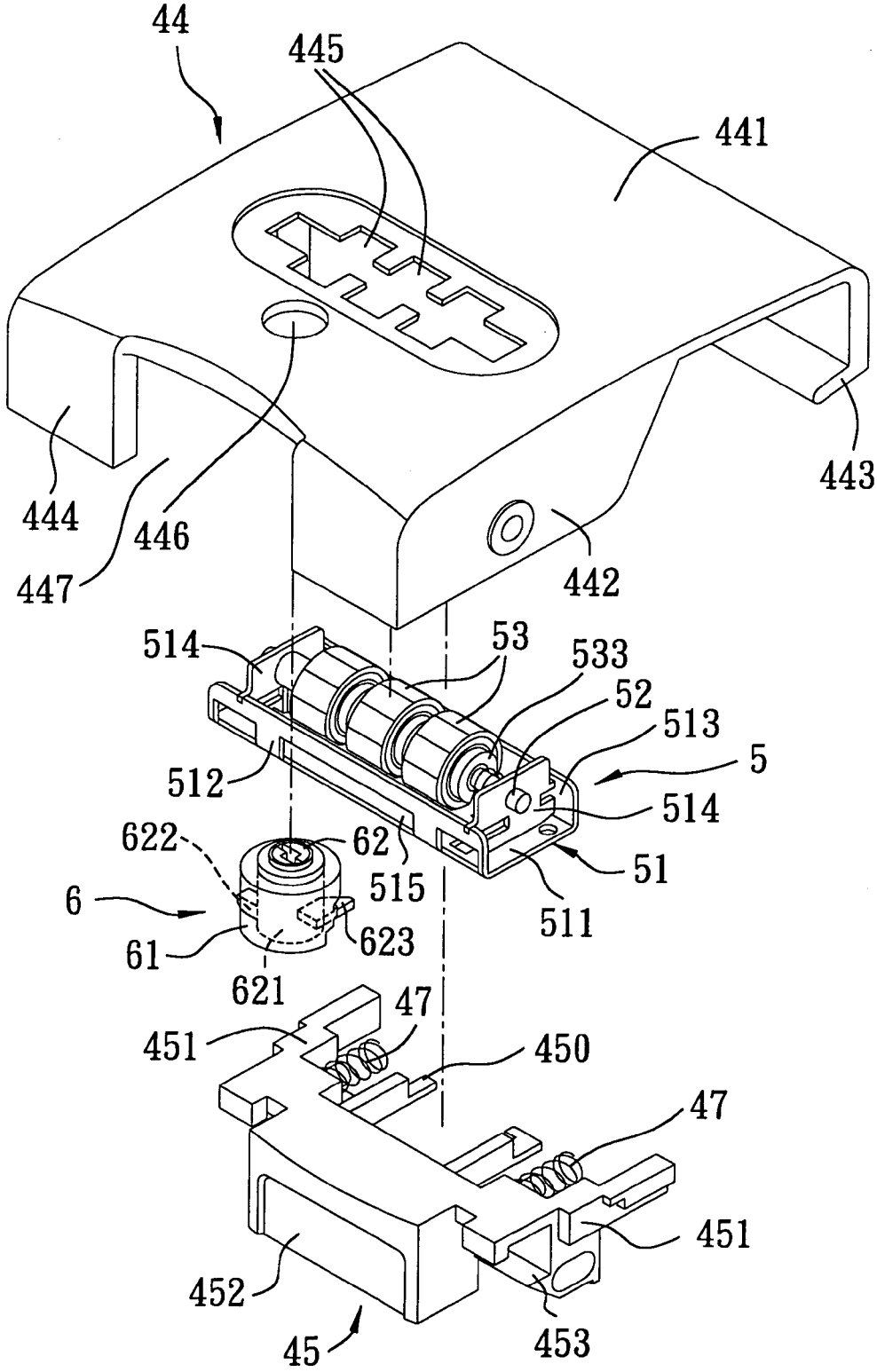
FIG. 3 is an exploded perspective view of the preferred embodiment.

Referring to FIGS. 3 to 5, the dial lock 5 further includes a lock housing 51 disposed below the latch base wall 441 of the case latching member 44. The lock housing 51 includes an elongate bottom plate 511, first and second holding plates 512, 513 extending upwardly from two opposite sides of the bottom plate 511, a pair of spaced apart shaft-mounting plates 514 extending upwardly from the bottom plate 511 between the first and second holding plates 512, 513, a dial shaft 52 extending between and mounted on the shaft-mounting plates 514, and a plurality of rotatable dials 53 (three dials 53 are provided on the dial lock 5 in this embodiment) sleeved on the dial shaft 52 and extending into the dial slot 445. The limiting lever 54' is pivotably mounted on the bottom plate 511 of the lock housing 51, and is disposed below the dials 53. The dial lock 5 further includes at least a compression spring 55 disposed between the limiting lever 54' and the bottom plate 511 for urging the limiting lever 54' to move upwardly toward the dials 53. The first holding plate 512 of the lock housing 51 is formed with an opening 515 for extension of the stopper 450 of the pressable button 45 therethrough. Each of the dials 53 has a bush 533 sleeved on the dial shaft 52 and formed with an accommodating recess 532, and is formed with dial numerals indented thereon. The limiting lever 54' further has a pivot end 541 pivoted to the bottom plate 511 of the lock housing 51 through the compression spring 55. The limiting lever 54' has three convex portions 543 (only one convex portion 543 is shown), each of which corresponds to the accommodating recess 532 in the bush 533 of a respective one of the dials 53.

Referring again to FIGS. 5 and 6, when a predetermined combination of the dial numbers of the dials 53 is formed, i.e., the dial lock 5 is disposed at the releasing state, the three convex portions 543 of the limiting lever 54' are respectively registered with and are urged into the three accommodating recesses 532 in the bushes 533 of the dials 53 by the urging action of the compression spring 55, thereby permitting movement of the limiting lever 54' to the upper position as best shown in FIG. 5, which, in turn, permits movement of the pressable button 45 to the pressed position. On the other hand, when the dial numbers of the dials 53 do not form the predetermined combination, i.e., the dial lock 5 is disposed at the locking state, the limiting lever 54' is depressed by the bushes 533 of the dials 53 against the urging action of the compression spring 55 and is retained at the middle position as best shown in FIG. 6, thereby preventing movement of the pressable button 45 to the pressed position.

Referring to FIG. 3, the key-operated unlocking unit 6 further includes a mounting sleeve 61 fixedly mounted on the base wall 441 of the case latching member 44 for mounting of the cylindrical wall 621 thereon. The mounting sleeve 61 is formed with a notch for extension of the driving protrusion 622 and the stopping protrusion 623 therethrough.

Referring again to FIGS. 3, 7 and 8, when the dial lock 5 of the combination lock 20 is disposed in the locking state as shown in FIG. 6, without releasing the dial lock 5 from the locking state, the case latching member 44 still can be permitted to move from the latching position to the unlatching position by operating a key (not shown) to rotate the core 62 of the key-operated unlocking unit 6 to the second angular position so as to extend the driving protrusion 622 through the opening 515 in the first holding plate 512 of the lock housing 51 to press downward the limiting end 542 of the limiting lever 54', and by moving the pressable button 45 to the pressed position to release the pressable button 45 from the engaging hooks 33. Hence, with the inclusion of the driving protrusion 622 in the key-operated unlocking unit 6 of the combination lock 20 of this invention, the combination lock 20 can be unlocked for inspection using a particular key.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A combination lock for locking first and second casing halves of a suitcase, said combination lock comprising:

a base mounted securely on one of the first and second casing halves;

a case locking mechanism mounted on said base and operable to move between a locking position to lock the first and second casing halves, and a releasing position to release the locking action of said case locking mechanism on the first and second casing halves;

a dial lock mounted on said case locking mechanism, including a lock controlling member, and operable between a locking state, in which said case locking mechanism is prevented from moving from the locking position to the releasing position by said lock controlling member, and a releasing state, in which said case locking mechanism is released from said lock controlling member and is permitted to move from the locking position to the releasing position; and a key-operated unlocking unit mounted on said case locking mechanism and including a core that is rotatable between first and second angular positions, and that is associated with said lock controlling member in such a manner that said case locking mechanism is prevented from moving from the locking position to the releasing position by said lock controlling member when said dial lock is disposed at said locking state and when said core is disposed at said first angular position, and that said case locking mechanism is released from said lock controlling member and is permitted to move from the locking position to the releasing position when said core is disposed at said second angular position;

wherein said lock controlling member includes a limiting lever that is fulcrumable among a middle position, in which said case locking mechanism is prevented from moving from the locking position to the releasing position by said limiting lever, an upper position, in which said case locking mechanism is released from said limiting lever and is permitted to move from the locking position to the releasing position, and a lower position, in which said case locking mechanism is released from said limiting lever and is permitted to move from the locking position to the releasing position.

2. The combination lock as claimed in claim 1, wherein said case locking mechanism includes a case latching member that is rotatable between a latching position to engage the other of the first and second casing halves to thereby dispose said case locking mechanism at the locking position, and an unlatching position to disengage from the other of the first and second casing halves to thereby dispose said case locking mechanism at the releasing position, said case locking mechanism further including a spring-biased pressable button that is mounted movably on said case latching member, that is movable in a moving direction between pressed and non-pressed positions, and that is formed with a stopper, said case latching member being permitted to rotate from the latching position to the unlatching position when said pressable button is disposed at the pressed position, and being prevented from moving from the latching position to the unlatching position when said pressable button is disposed at the non-pressed position, said limiting lever having a limiting end that confronts and that is aligned with said stopper in said moving direction when said limiting lever is disposed at said middle position, thereby preventing said pressable button from moving from the non-pressed position to the pressed position, and that is offset from said stopper in said moving direction when said limiting lever is disposed at one of the upper and lower positions, thereby permitting said pressable button to move from the non-pressed position to the pressed position.

3. The combination lock as claimed in claim 2, wherein said core has a cylindrical wall that is formed with a driving protrusion protruding radially therefrom and having a curved guiding face, said limiting lever being moved from said middle position to said lower position by said driving protrusion when said core is rotated from said first angular position to said second angular position, said curved guiding face of said driving protrusion being in sliding contact with said limiting end of said limiting lever during movement of said core from the first angular position to the second angular position.

4. The combination lock as claimed in claim 3, wherein said cylindrical wall of said core is further formed with a stopping protrusion protruding therefrom and displaced angularly from said driving protrusion for limiting rotation of said core to be within the first and second angular positions.

* * * * *